United States Patent [19]

Spaeth

[11] Patent Number: 5,056,545

[45] Date of Patent: Oct. 15, 1991

[54] SAFETY WALKING CANE

[76] Inventor: Phillip A. Spaeth, Box 507, Kearney, Mo. 64060

[21] Appl. No.: 597,553

[22] Filed: Oct. 15, 1990

[51] Int. Cl.[5] ..... A45B 1/00

[52] U.S. Cl. ..... 135/66; 135/85; 135/911; 362/102

[58] Field of Search ..... 135/65, 66, 84, 85, 135/DIG. 10, DIG. 11, 16; 362/102; 272/70.3

[56] References Cited

U.S. PATENT DOCUMENTS

| | | | |
|---|---|---|---|
| 2,198,082 | 4/1940 | Harty | 135/DIG. 10 X |
| 4,062,371 | 12/1977 | Bolen | 135/66 |
| 4,062,372 | 12/1977 | Slusher | 135/66 |
| 4,086,932 | 5/1978 | Richardson | 272/70.3 X |
| 4,700,730 | 10/1987 | Samuelson et al. | 272/70.3 X |
| 4,915,670 | 4/1990 | Nesbit | 135/16 X |

FOREIGN PATENT DOCUMENTS

| | | | |
|---|---|---|---|
| 252535 | 6/1964 | Australia | 362/102 |

*Primary Examiner*—Richard E. Chilcot, Jr.
*Assistant Examiner*—Lan Mai
*Attorney, Agent, or Firm*—Leon Gilden

[57] ABSTRACT

An apparatus setting forth a walking cane provided with requisite safety features defined by an elongate cane shaft formed with a lowermost friction tip at its lower terminal end and a handle at its upper terminal end, with safety wheels mounted adjacent a lower terminal end, with lower surfaces of the safety wheels aligned with the lower tip. A light reflector is provided on the shaft and positioned medially between the spaced wheels and oriented forwardly thereof, and further including a water supply reservoir removably mounted relative to the shaft, a mirror, and a horn member, as well as an audible play-back device to alert others as to the positioning of the shaft in use.

1 Claim, 4 Drawing Sheets

12
33
32a
32
31
27
29
28
30
35
34
11
19
21
24
35
26
25
22
20
23
35
18
15
16
17
14
16
13

SAFETY WALKING CANE

BACKGROUND OF THE INVENTION

1. Field of the Invention

The field of invention relates to walking paraphernalia, and more particularly pertains to a new and improved safety walking cane including a cooperative coordination of components to alert others of an individual utilizing the cane organization.

2. Description of the Prior Art

Walking paraphernalia of various types have been utilized in the prior art, but heretofore lacked convenient structure permitting bystanders to be alerted of an individual utilizing the cane organization. Prior art structure may be found in U.S. Pat. No. 1,526,246 to Simek setting forth a cane structure, with a handbag organization mounted medially of the cane structure for support of various components therewithin.

U.S. Pat. Nos. Des. 218,508; Des. 222,207; Des. 276,668; and Des. 291,148 set forth design configurations including various components in a cane organization, wherein U.S. Pat. No. Des. 222,207 presents the use of a configurational horn structure in cooperation with the cane organization.

As such, it may be appreciated that there continues to be a need for a new and improved safety walking cane as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of walking canes now present in the prior art, the present invention provides a safety walking cane wherein the same utilizes a cooperative organization of various components to provide selective and desired attention to an individual utilizing the organization that further mounts a safety wheel structure in use with the cane. As such, the general purpose of the present invention, which will be described subsequently in greater detail, is to provide a new and improved safety walking cane which has all the advantages of the prior art walking canes and none of the disadvantages.

To attain this, the present invention provides an apparatus setting forth a walking cane provided with requisite safety features defined by an elongate cane shaft formed with a lowermost friction tip at its lower terminal end and a handle at its upper terminal end, with safety wheels mounted adjacent a lower terminal end, with lower surfaces of the safety wheels aligned with the lower tip. A light reflector is provided on the shaft and positioned medially between the spaced wheels and oriented forwardly thereof, and further including a water supply reservoir removably mounted relative to the shaft, a mirror, and a horn member, as well as an audible play-back device to alert others as to the positioning of the shaft in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety walking cane which has all the advantages of the prior art walking canes and none of the disadvantages.

It is another object of the present invention to provide a new and improved safety walking cane which may be easily and efficiently manufactured and marketed.

It is a further object of the present invention to provide a new and improved safety walking cane which is of a durable and reliable construction.

An even further object of the present invention is to provide a new and improved safety walking cane which is susceptible of a low cost of manufacture with regard to both materials and labor, and which accordingly is then susceptible of low prices of sale to the consuming public, thereby making such safety walking canes economically available to the buying public.

Still yet another object of the present invention is to provide a new and improved safety walking cane which provides in the apparatuses and methods of the prior art some of the advantages thereof, while simultaneously overcoming some of the disadvantages normally associated therewith.

Still another object of the present invention is to provide a new and improved safety walking cane wherein the same provides stability in use, as well as selectively alerting of an individual utilizing the walking cane of the instant invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
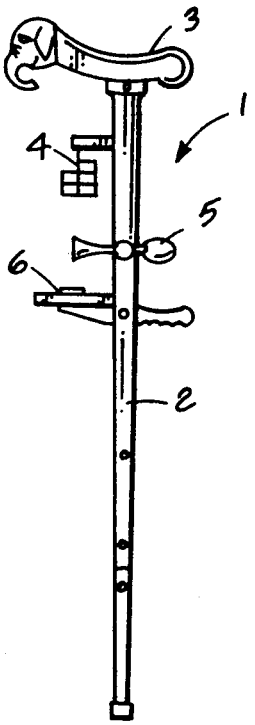
FIG. 1 is an orthographic view, taken in elevation, of a prior art walking cane structure.
Figure 2:
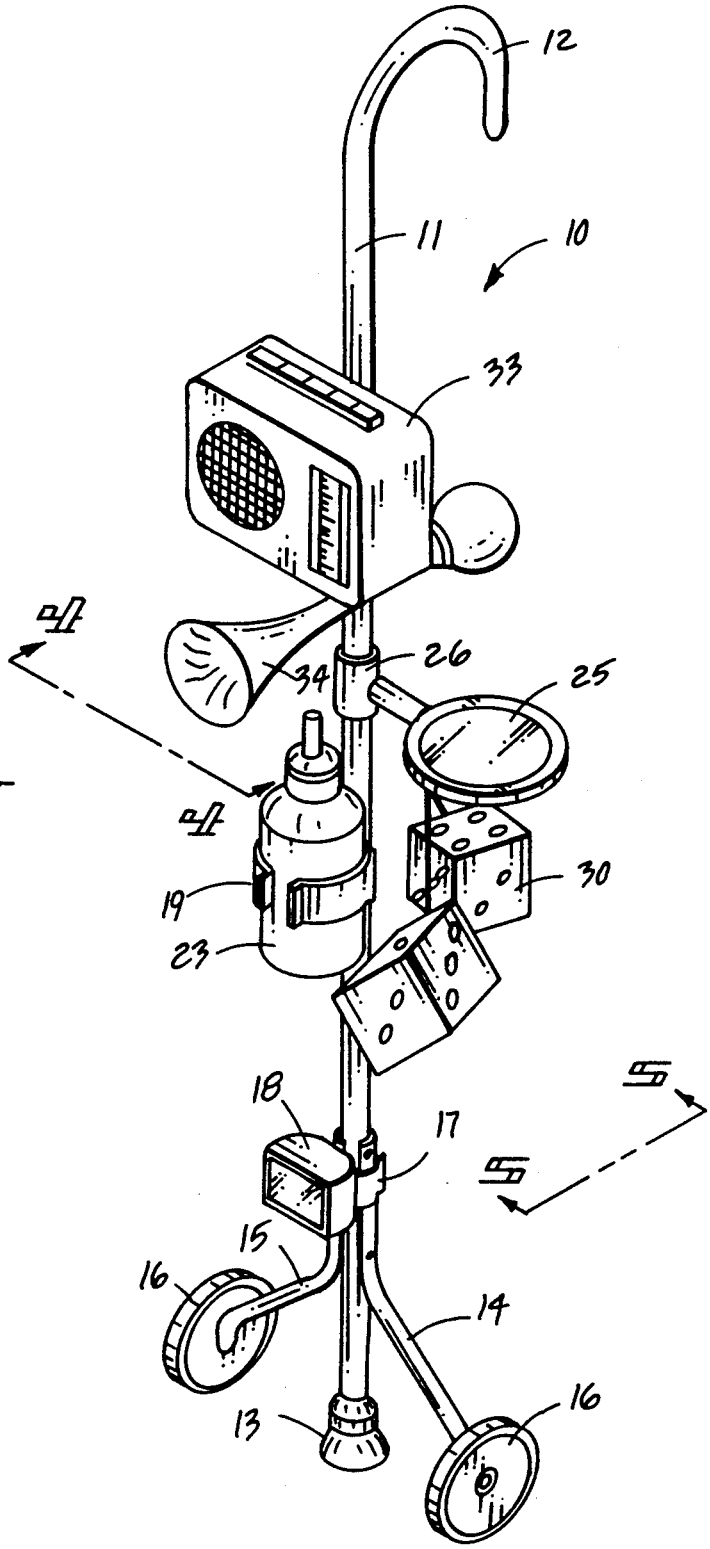
PRIOR ART Fig 2
FIG. 2 is an isometric illustration of the instant invention.

With reference now to the drawings, and in particular to FIGS. 1 to 5 thereof, a new and improved safety walking cane embodying the principles and concepts of the present invention and generally designated by the reference numeral 10 will be described.

FIG. 1 illustrates a prior art walking cane structure, as set forth in U.S. Pat. No. Des. 222,207, that provides a cane shaft 2, with an arcuate handle 3 at its upper end, and a cup holder 4, with a horn 5 and an ashtray 6.

More specifically, the safety walking cane 10 of the instant invention, as set forth in FIGS. 2-5, essentially provides a cane structure arranged for directing attention to and alerting others of the use of the cane structure by an individual, as well as affording stability to the cane structure in use. An elongate, longitudinally aligned cane shaft 11 includes a handle 12 at its uppermost end for grasping by an individual, with a resilient friction tip 13 mounted at a lower terminal end of the shaft 11. A respective first and second wheel support bracket 14 and 15 defined by respective first and second lower legs, each of a generally "Z" shaped configuration, are mounted adjacent the lower terminal end of the cane shaft and diametrically positioned on opposite sides of the shaft 11 rotatably mounting a support wheel 16 at each lower terminal end of each support bracket, with a lower rolling surface of each support wheel aligned with the friction tip 13 to provide support of the cane shaft, with each support wheel employing an elastomeric exterior surface that is compressed, whereupon application of pressure to the shaft provides each elastomeric rim of each support wheel is deflected to permit the friction tip 13 to frictionally engage an underlying support surface in use.

A "C" shaped first mounting bracket 17, including spring-biased jaws, is fixedly secured to a reflector 18. The spring-biased jaws of the first mounting bracket are mounted about the upper legs of each of the wheel support brackets 14 and 15, and orients the reflector 18 medially and orthogonally bisecting the spacing defined between the brackets 14 and 15 to orient the reflector 18 forwardly in use to provide a visual warning of orientation of the reflector by motor vehicles and the like during limited light conditions.

Figure 3:
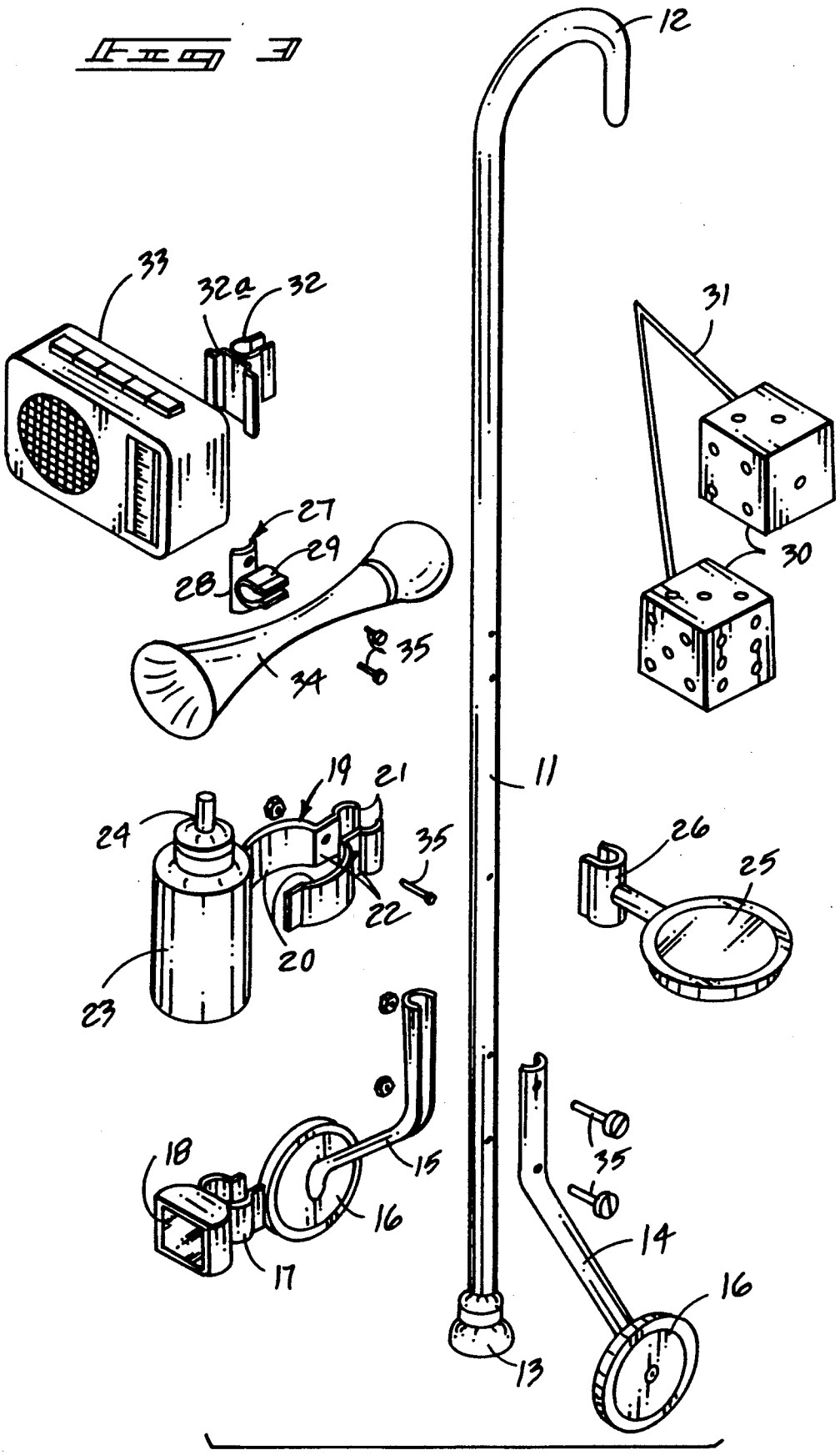
FIG. 3 is an isometric exploded illustration of the instant invention.
Figure 4:
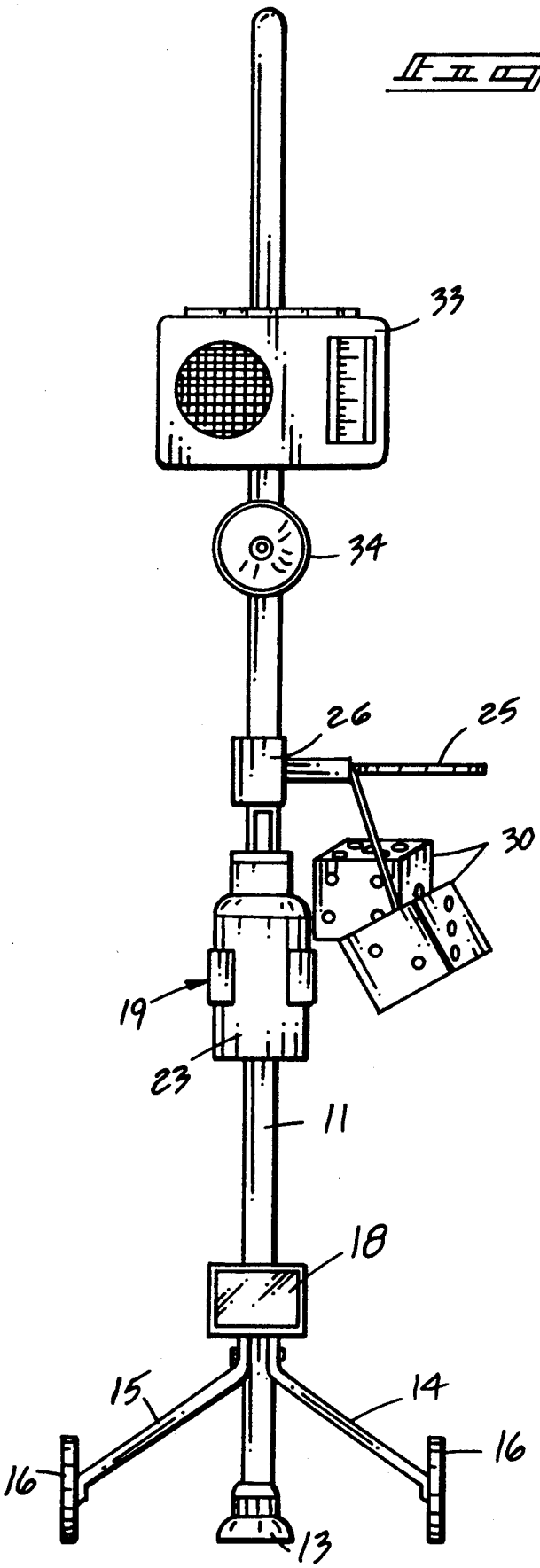
FIG. 4 is an orthographic view, taken in elevation, taken along the lines 4—4 of FIG. 2 in the direction indicated arrows.
Figure 5:
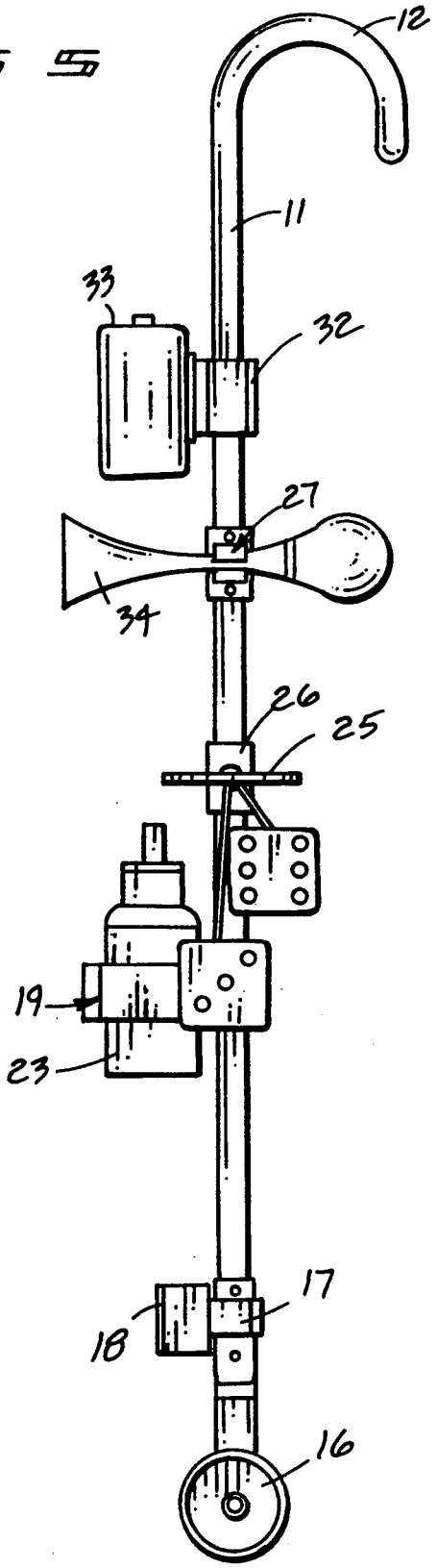
FIG. 5 is an orthographic view, taken in elevation, taken along the lines 5—5 of FIG. 2 in the direction indicated by the arrows.

A second mounting bracket 19 includes a forward "C" shaped jaw pair 20 and a rear "C" shaped jaw pair 21, with each jaw of a respective forward and rear jaw pair mounted relative to one another by a central planar web 22, in a manner as illustrated in FIG. 3, permitting reception of a fastener 35 to an associated aperture within the shaft 11 to secure the second bracket 19 to the shaft 11, with the forward "C" shaped jaw pair 20 securing a water container 23 therebetween in a selectively removable manner containing a nozzle member 24 to permit selective removal of the container 23 for use by an individual. A mirror 25 is mounted to a "C" shaped third bracket member 26 that further includes spring-biased jaws to mount the third mounting bracket 26 to the shaft 11 above the water container 23. A fourth mounting bracket 27 includes a semi-cylindrical mounting plate 28 mounting a "C" shaped spring-biased jaw pair 29 thereon to secure an elongate horn member 34 within the "C" shaped spring-biased jaw pair 29, with the semi-cylindrical mounting 28 including apertures aligned with further apertures within the shaft 11 to receive further fasteners 35 in mounting of the plate 28 and the associated fourth mounting bracket 27 to the shaft 11. An amusement die pair 30, with a tether line 31, is mounted about the mirror 25 to enhance alerting of individuals as to the presence of the walking cane structure 10 of the instant invention.

Further, a fifth mounting bracket 32, including a spring-biased fifth bracket jaw pair and a support plate 32*a* mounted to the shaft adjacent the handle 12, includes a tape player and radio receiver 33 mounted to the support plate 32*a* to permit an individual to further sound an audible alarm of various types to alert individuals as to the presence of the walking cane organization.

Accordingly, the cooperative components of the walking cane structure sets forth a synergistic combination of numbers to provide alerting of the presence of an individual utilizing the cane structure, as set forth by the instant invention.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A safety walking cane comprising, in combination,
   an elongate shaft, the shaft including a handle at an upper terminal end of the shaft, and
   a resilient friction tip mounted at a lower terminal end of the shaft, and
   stabilizing means mounted adjacent the lower terminal end of the shaft extending laterally of the shaft for imparting stability to the shaft during use, and
   a reflector member, including a first mounting bracket, with the first mounting bracket securable to the stabilizing means, and wherein the stabilizing means includes a first and second generally "Z" shaped wheel support bracket, the first and second wheel support brackets fixedly mounted to the can shaft on diametrically opposed sides of the cane shaft, and the first and second respective wheel support brackets including respective first and second lower legs, with each respective first and second lower leg rotatably mounting a support wheel, each support wheel diametrically aligned relative to the shaft and extending laterally thereof, and each support wheel including an elastomeric rim, the elastomeric rim aligned with the friction tip in a first position, wherein each elastomeric rim of each support wheel is compressible to permit engagement of the friction tip relative to an underlying support surface, and wherein the reflector member is mounted within a housing, and the housing is mounted to the first mounting bracket, and the reflector orthogonally bisecting a spacing between the first and second wheel support brackets, and including a second mounting bracket, the second mounting bracket including a forward "C" shaped jaw pair and a rear "C" shaped jaw pair, and the rear "C" shaped jaw pair mounted to the shaft, and the forward "C" shaped jaw pair mounted resiliently including a water container, the water container including a nozzle member mounted to an upper terminal end of the water container, and including a third mounting bracket, the third mounting bracket mounted to the shaft above the second mounting bracket, and the third mounting bracket including spring-biased jaws to engage the shaft with the third mounting bracket fixedly mounting a mirror thereto, and including a fourth mounting bracket, the fourth mounting bracket mounted on the shaft above the third mounting bracket, and including a horn member secured to the fourth mounting bracket, and the fourth mounting bracket including a semi-cylindrical mounting plate fixedly mounted to the shaft, and the semi-cylindrical mounting plate including a fourth mounting bracket "C" shaped spring-biased jaw pair to resiliently secure the horn member to the fourth mounting bracket, and including a fifth mounting bracket fixedly mounted to the shaft above the fourth mounting bracket, with the fifth mounting bracket including an audible tape member to permit play-back of various audible tapes from the tape player and a radio receiver.

* * * * *